US006170539B1

(12) United States Patent
Pope et al.

(10) Patent No.: US 6,170,539 B1
(45) Date of Patent: Jan. 9, 2001

(54) VAPOR RECOVERY SYSTEM FOR FUEL DISPENSER

(75) Inventors: Kenneth L. Pope, Walkertown; Richard R. Sobota, Kernersville; Seifollah S. Nanaji; Edward A. Payne, both of Greensboro, all of NC (US)

(73) Assignee: Mokori Commerce Systems Inc., Greensboro, NC (US)

( * ) Notice: Under 35 U.S.C. 154(b), the term of this patent shall be extended for 0 days.

(21) Appl. No.: 09/408,292

(22) Filed: Sep. 29, 1999

(51) Int. Cl.[7] ..... B65B 1/04
(52) U.S. Cl. ..... 141/59; 141/83
(58) Field of Search ..... 141/59, 94, 83, 141/192, 392; 73/861.85, 204.22

(56) References Cited

U.S. PATENT DOCUMENTS

| | | | |
|---|---|---|---|
| 4,098,303 | 7/1978 | Gammell | 141/52 |
| 4,435,978 | 3/1984 | Glatz | 73/155 |
| 4,930,347 | 6/1990 | Henderson | 73/189 |
| 5,040,577 | 8/1991 | Pope | 141/59 |
| 5,156,199 | 10/1992 | Hartsell, Jr. et al. | 141/83 |
| 5,195,564 | 3/1993 | Spalding | 141/1 |
| 5,231,877 | 8/1993 | Henderson | 73/204.25 |
| 5,280,814 | 1/1994 | Stroh | 141/83 |
| 5,310,449 | 5/1994 | Henderson | 156/628 |
| 5,323,817 | 6/1994 | Spalding | 141/1 |
| 5,332,008 | 7/1994 | Todd et al. | 141/5 |
| 5,332,011 | 7/1994 | Todd et al. | 141/59 |
| 5,355,915 | 10/1994 | Payne | 141/83 |
| 5,465,606 | 11/1995 | Janssen et al. | 73/23.2 |
| 5,671,785 | 9/1997 | Andersson | 141/59 |
| 5,710,380 | 1/1998 | Talley et al. | 73/861.85 |
| 5,782,275 * | 7/1998 | Hartsell, Jr. et al. . | |
| 5,832,967 | 11/1998 | Andersson | 141/59 |
| 5,860,457 | 1/1999 | Andersson | 141/59 |
| 5,913,343 | 6/1999 | Andersson | 141/59 |
| 5,944,067 | 8/1999 | Andersson | 141/59 |

FOREIGN PATENT DOCUMENTS

| | | | |
|---|---|---|---|
| WO 98/31628 | 7/1998 | (WO) | B67D/5/04 |

* cited by examiner

*Primary Examiner*—Steven O. Douglas
(74) *Attorney, Agent, or Firm*—Coats & Bennett, P.L.L.C.

(57) ABSTRACT

A vapor recovery system includes an anemometer positioned in the vapor return line to calculate the volume of returning vapor in the vapor return line. The anemometer is connected to a control system which compares the volume of returning vapor to the volume of fuel being dispensed and adjusts the speed at which vapor is recovered so that the two volumes approximately equal one another. The anemometer may be a Wheatstone bridge arrangement or a pair of thermometers.

18 Claims, 3 Drawing Sheets

VAPOR RECOVERY SYSTEM FOR FUEL DISPENSER

FIELD OF THE INVENTION

The present invention pertains to a vapor recovery system for a fuel dispenser and more particularly to a system that includes a feedback mechanism to control more accurately vapor flow.

BACKGROUND OF THE INVENTION

Vapor recovery fuel dispensers, particularly gasoline dispensers, have been known for quite some time, and have been mandatory in California for a number of years. The primary purpose of using a vapor recovery fuel dispenser is to retrieve or recover the vapors, which would otherwise be emitted to the atmosphere during a fueling operation, particularly for motor vehicles. The vapors of concern are generally those which are contained in the vehicle gas tank. As liquid gasoline is pumped into the tank, the vapor is displaced and forced out through the filler pipe. Other volatile liquids such as hydrocarbon fluids raise similar issues.

A traditional vapor recovery apparatus is known as the "balance" system, in which a sheath or boot encircles the liquid fueling spout and connects by tubing back to the fuel reservoir. As the liquid enters the tank, the vapor is forced into the sheath and back toward the fuel reservoir or underground storage tank (UST) where the vapors can be stored or recondensed. Balance systems have numerous drawbacks, including cumbersomeness, difficulty of use, ineffectiveness when seals are poorly made, and slow fueling rates.

As a dramatic step to improve on the balance systems, Gilbarco, Inc., assignee of the present invention, patented an improved vapor recovery system for fuel dispensers, as seen in U.S. Pat. No. 5,040,577 to Pope, which is herein incorporated by reference. The Pope patent discloses a vapor recovery apparatus in which a vapor pump is introduced in the vapor return line and is driven by a variable speed motor. The liquid flow line includes a pulser, conventionally used for generating pulses indicative of the liquid fuel being pumped. This permits computation of the total sale and the display of the volume of liquid and the cost in a conventional display, such as, for example as shown in U.S. Pat. No. 4,122,524 to McCrory et al. A microprocessor translates the pulses indicative of the liquid flow rate into a desired vapor pump operating rate. The effect was to permit the vapor to be pumped at a rate correlated with the liquid flow rate so that, as liquid is pumped faster, vapor is also pumped faster.

There are three basic embodiments used to control vapor flow during fueling operations. The first embodiment is the use of a constant speed vapor pump during fueling without any sort of control mechanism. The second is the use of a pump driven by a constant speed motor coupled with a controllable valve to extract vapor from the vehicle gas tank. While the speed of the pump is constant, the valve may be adjusted to increase or decrease the flow of vapor. The third is the use of a variable speed motor and pump as described in the Pope patent, which is used without a controllable valve assembly. All three techniques have advantages either in terms of cost or effectiveness, and depending on the reasons driving the installation, any of the three may be appropriate. The present state of the art is well shown in commonly owned U.S. Pat. No. 5,345,979, which is herein incorporated by reference.

Regardless of whether the pump is driven by a constant speed motor or a variable speed motor, there is no feedback mechanism to guarantee that the amount of vapor being returned to the UST is correct. A feedback mechanism is helpful to control the A/L ratio. The A/L ratio is the amount of vapor-air being returned to the UST divided by the amount of liquid being dispensed. An A/L ratio of 1 would mean that there was a perfect exchange. Often, systems have an A/L >1 to ensure that excess air is recovered rather than allowing some vapor to escape. This inflated A/L ratio causes excess air to be pumped into the UST, which results in a pressure build up therein. This pressure build up can be hazardous, and as a result most USTs have a vent that releases vapor-air mixtures resident in the UST to the atmosphere should the pressure within the UST exceed a predetermined threshold. While effective to relieve the pressure, it does allow hydrocarbons or other volatile vapors to escape into the atmosphere.

While PCT application Ser. No. PCT/GB98/00172 published Jul. 23, 1998 as WO 98/31628, discloses one method to create such a feedback loop using a Fleisch tube, there remains a need to create alternate feedback mechanisms to more accurately measure the vapor flow in a vapor recovery system in order to minimize the need to vent the UST to the atmosphere and ensure proper vapor recovery.

SUMMARY OF THE INVENTION

The aforedescribed need for an alternate feedback system is solved by the use of microanemometer technology (MT). An anemometer formed in an integrated circuit is placed in the vapor return line, preferably proximate the vapor pump. The anemometer provides an accurate measurement of the velocity of the vapor flow thereacross. Coupled with the knowledge of the diameter of the vapor return line, an accurate measurement of the volume of the returning vapor can be calculated. From this volume measurement, a microprocessor can control the variable speed motor or the valve associated with a constant speed motor to make sure that the vapor extraction is equivalent to the fuel insertion within the vehicle fuel tank. An alternate embodiment includes at least one and preferably a pair of thermometers or temperature probes positioned in the vapor recovery line that can be used to determine the vapor flow therethrough.

DETAILED DESCRIPTION OF THE PREFERRED EMBODIMENT

Figure 1:
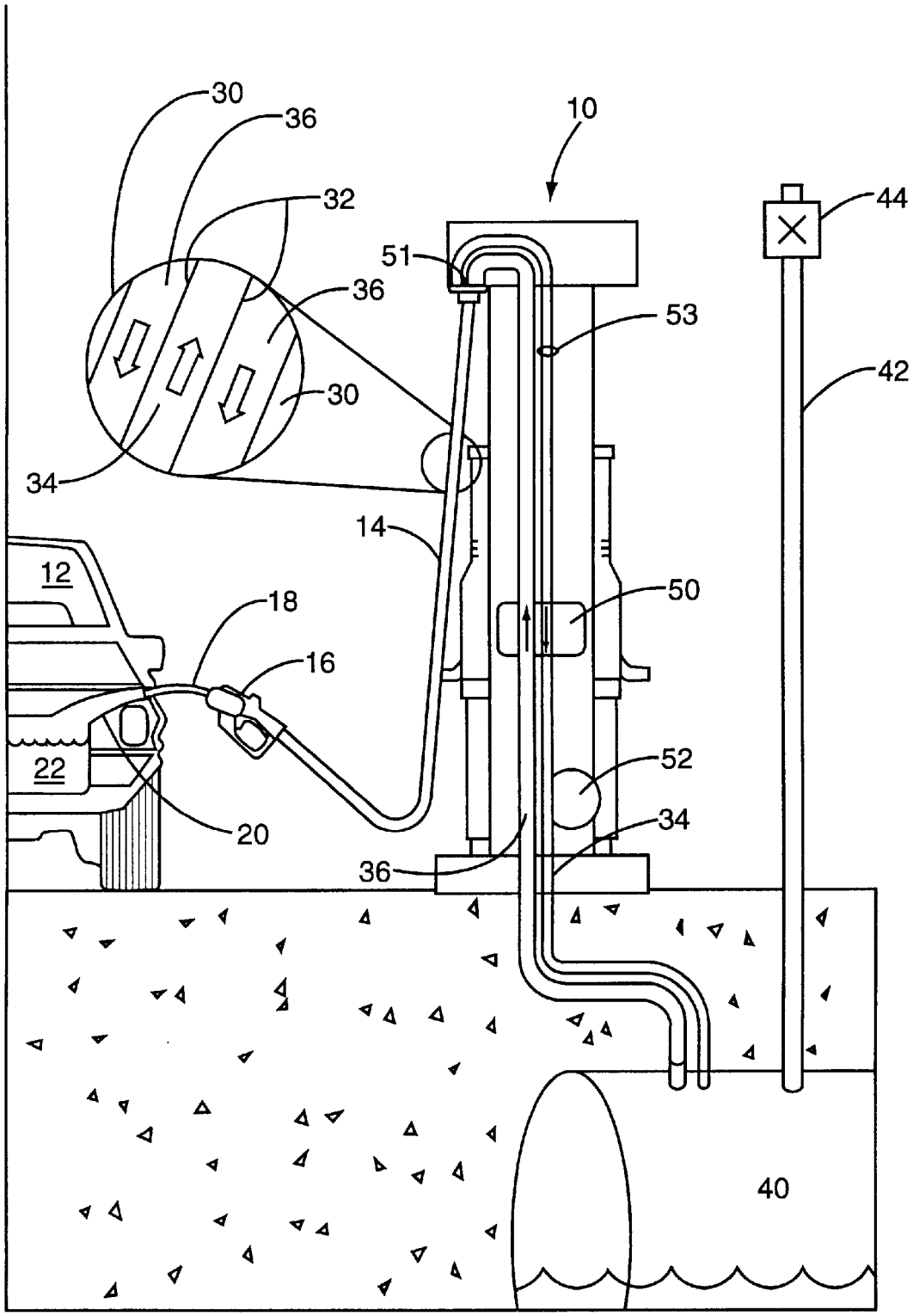
FIG. 1 is a vapor recovery system according to the present invention.

Turning now to FIG. 1, a fuel dispenser 10 is adapted to deliver a fuel, such as gasoline or diesel fuel to a vehicle 12 through a delivery hose 14, and more particularly through a nozzle 16 and spout 18. The vehicle 12 includes a fill neck 20 and a tank 22, which accept the fuel and provide it through appropriate fluid connections to the engine (not shown) of the vehicle 12.

Presently, it is known in the field of vapor recovery to provide the flexible delivery hose 14 with an outer conduit 30 and an inner conduit 32. The annular chamber formed between the inner and outer conduits 30, 32 form the product delivery line 36. The interior of the inner conduit 32 forms the vapor return line 34. Both lines 34 and 36 are fluidly connected to an underground storage tank (UST) 40 through the fuel dispenser 10. Once in the fuel dispenser 10, the lines 34 and 36 separate at split 51. The UST 40 is equipped with a vent shaft 42 and a vent valve 44. During delivery of fuel into the tank 22, the incoming fuel displaces air containing fuel vapors. The vapors travel through the vapor return line 34 to the UST 40.

The fuel dispenser 10 is controlled by a control system 50, which includes appropriate electronic circuitry such as a microprocessor or the like. The control system 50 controls a vapor recovery system 52 through appropriate electrical connections as shown and described in reference to FIGS. 2A–2C.

Figure 2A:
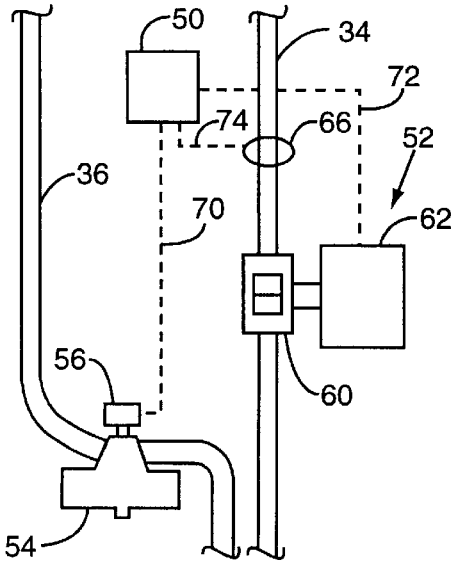
FIG. 2A is the vapor flow meter coupled with a variable speed motor.

FIG. 2A shows the product delivery line 36, which includes a flow meter 54 and a pulser 56. The pulser 56 generates electrical pulse signals indicative of the amount of displacement occurring in the meter 54. Typical pulsers 56 generate 1000 pulses for 1 gallon of fuel displaced. The pulser 56 is operatively connected to the control system 50 as generally indicated by pulser data stream 70. The vapor recovery system 52 is positioned proximate the vapor return line 34 and includes a vapor pump 60 driven by a vapor motor 62. A vapor flow monitor 66 is positioned within the vapor return line 34 and is explained in greater detail below. The motor 62 is operatively connected to the control system 50 by pump control data stream 72. The monitor 66 is operatively connected to the control system by flow feedback data stream 74. It should be appreciated that data streams 70, 72, 74 and valve control data stream 76 (explained below) could be implemented by conventional wiring or wireless transceivers and the like.

In operation, the motor 62 in FIG. 2A, is a variable speed motor that causes pump 60 to behave as a variable speed pump. The pump 60 is constructed to handle vapor laden air and liquid fuel without risk of explosion or overheating. Such pumps are conventional and well understood.

Figure 2B:
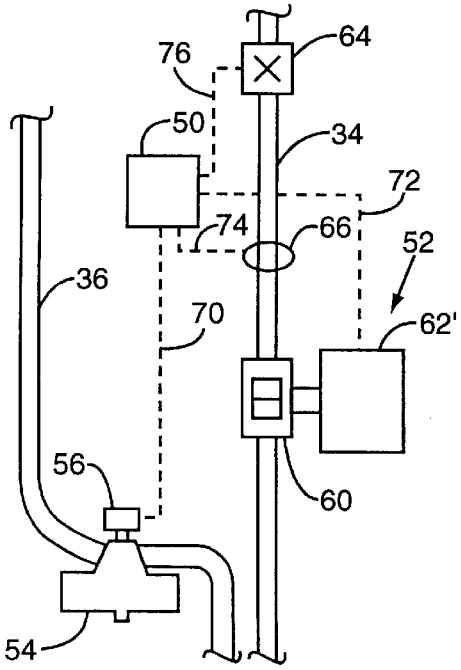
FIG. 2B is the vapor flow meter coupled with a constant speed motor and adjustable valve.

An alternate arrangement for a constant speed pump is seen in FIG. 2B, wherein motor 62' is a constant speed motor, which forces the pump 60 to behave as a constant speed pump. To control the flow of vapor trough the vapor recovery line 34, a vapor return valve 64 is positioned in the vapor return line 34. The vapor return valve 64 is operatively connected to the control system by valve control data stream 76. To increase the vapor flow, the valve 64 is opened wider. To reduce the vapor flow, the valve 64 is partially closed.

Figure 2C:
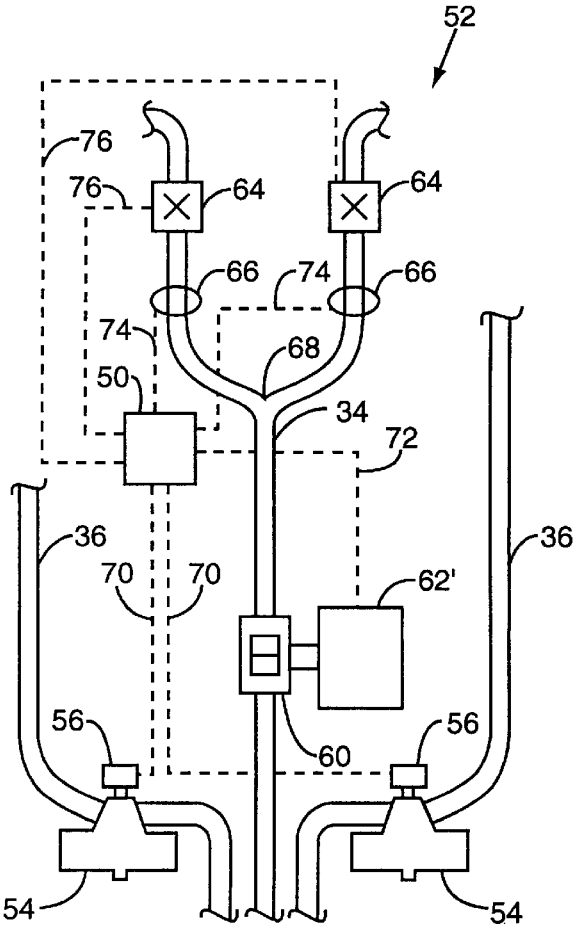
FIG. 2C is the vapor flow meter coupled with a constant speed motor and two adjustable valves for use in both sides of a fuel dispenser.

Still a third arrangement is seen in FIG. 2C, wherein a constant speed motor 62', coupled with a pump 60, is positioned downstream of a y-branch 68 of the vapor return line 34. In this configuration, the motor 62' drives the pump 60 continuously, creating a vacuum at y-branch 68. However, air is not drawn into the line 34 unless one of the valves 64 is opened. Thus, it is possible to recover simultaneously vapor from both sides of the fuel dispenser 10 using the same vapor recovery system 52. Heretofore, a single motor and pump has been impractical for use with both sides of the fuel dispenser 10. The reason for this is that it would be hard for one motor at one speed to recover vapors for two different fueling positions when two different cars are being fueled at potentially different rates. This is due in large part to the inability to ensure that a proper vacuum is created at both sides of the dispenser 10 to recover the vapors. In essence, what would happen in the prior art devices would be a good vacuum would be created on one side to recover vapor during a fueling transaction, and then the other side would begin dispensing fuel, resulting in the partial loss or reduction of vacuum at the first side. Without a feedback mechanism, there was no way to know how much to compensate in the first vapor recovery line. This problem is solved in the present arrangement by providing the valves 64 upstream of the pump 60, together with the feedback mechanism embodied in monitor 66. The combination allows the vapor recovery to be monitored in each branch of recovery line 34 while the valves 64 are adjusted to insure the proper vapor flow. Rather than rely on some sort of guestimation of the impact of the second side vapor recovery, a real time measurement can be made and the valves 64 adjusted until the desired vapor recovery is achieved in both branches. In this manner, the flow rates of the respective lines 34 may be varied relative to one another, while operating the motor 62' at a constant speed for both sides.

The vapor flow monitor 66 allows the A/L ratio to be monitored in real time and controlled to ensure that pressure build up in the UST 40 stays at a minimum. The monitor 66 would start detecting the amount of vapor flow once fuel flow begins and the vapor recovery process starts. Alternate starting times are also within the scope of the present invention. For example, the pump 60 may begin when the nozzle 16 is lifted from the fuel dispenser 10 to create an initial vacuum pressure by the time fuel begins to be dispensed. This helps insure immediate capture of vapor during the beginning of the fueling transaction. The amount of vapor measured by the monitor 66 is converted to an electrical signal and sent to the control system 50. The system 50 can compare the amount of actual vapor being returned versus the expected amount for the volumetric flow rate being delivered by the customer to the vehicle 12. This is due to the fact that the control system 50 is operatively connected to the flow meter 54 and pulser 56 of the product delivery line. The system 50 can then adjust either the variable speed motor 62 or the valves 64 to ensure a proper vapor recovery rate. While it is preferred that an A/L ratio of 1 be achieved by the manipulations of the control system 50, other ratios can be reached by programming adjustments within the controls system 50.

It should be noted that the advent of Onboard Recovery Vapor Recovery (ORVR) technology, in which the vehicle 12 recovers a large percentage of the vapor from within the gas tank 22, forces some modification to the present invention. Specifically, when a vehicle 12 being fueled includes an ORVR system, it is not desirable for the fuel dispenser 10 vapor recovery system 52 to compete with the ORVR system. There are several commercially available ORVR detection systems, such as that disclosed in U.S. Pat. No. 5,782,275, which is herein incorporated by reference. The present invention addresses this by providing an ORVR sensor 53, which may take one of several forms. A first form is a pressure sensor within the vapor recovery line 34. A second form is a hydrocarbon sensor within the vapor recovery line 34. A third form is a transponder arrangement, which receives an RF signal from a vehicle 12 with instructions that the vehicle 12 includes an ORVR system. Once detection of a vehicle 12 with an ORVR system occurs, various vapor recovery control options are available. Disabling the fuel dispenser's vapor recovery system 52 reduces UST 40 pressure, and thereby reduces losses due to fugitive emissions and reduces wear and unnecessary use of vapor recovery system 52. Alternatively, the dispenser's vapor recovery system 52 is adjusted to reduce the vacuum created by the fuel dispenser 10 during the fueling of an onboard vapor recovery equipped vehicle 12. Preferably, the vapor recovery system 52 provides enough ambient air to the UST 40, that when the air saturates, the hydrocarbon saturated air volume is approximately equal to the amount of fuel dispensed; thereby minimizing pressure fluctuation in the UST 40.

Figure 3:
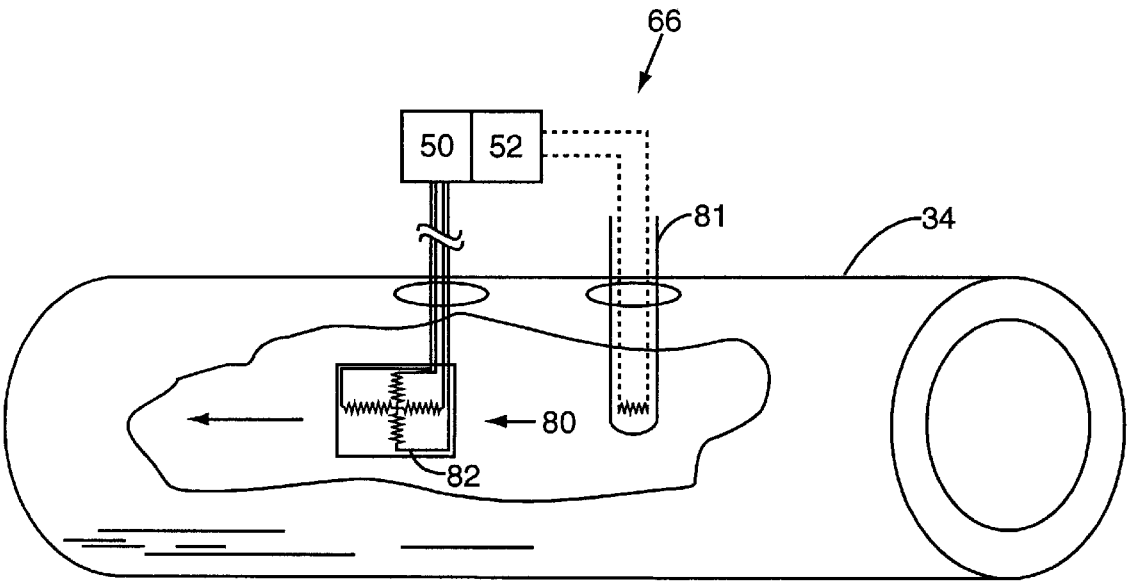
FIG. 3 is a first embodiment of the vapor return flow monitor.
Figure 4:
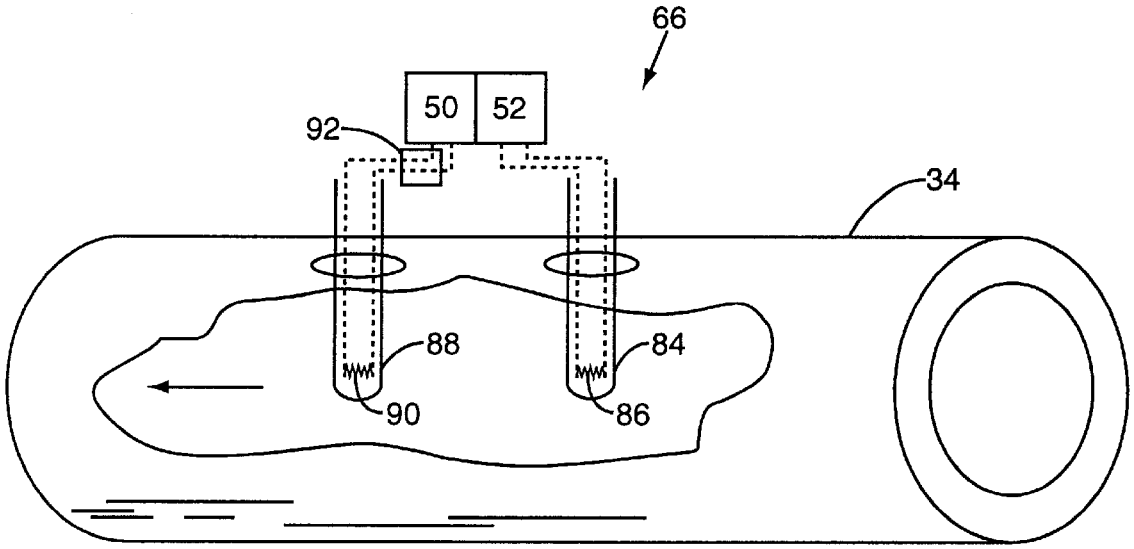
FIG. 4 is a second embodiment of the vapor return flow monitor.

The vapor monitor 66 may take a number of different forms, but the two preferred embodiments are seen in FIGS. 3 and 4. The first embodiment, seen in FIG. 3, comprises a solid state anemometer 80 including a Wheatstone bridge 82. An anemometer is a device, which measures the velocity and direction of gas flow. A Wheatstone bridge can be used as an anemometer. A Wheatstone bridge comprises four resistances connected together in a square configuration, with two pairs of parallel connecting legs forming the sides of the square, and four electrically conductive contacts located at the corners. Application of a known voltage between two diagonally opposed corner contacts results in a voltage reading on a meter connected across the other diagonally opposed corner contacts.

A Wheatstone bridge with four resistances of known value can be used as a sensor to measure parameters such as pressure, force, flow rate and direction. Such a Wheatstone bridge is symmetrical, and, in principal, remains in balance for any ambient temperature. However, gas or other mass flow across the bridge cools the legs that are perpendicular to the flow. Because resistivity of most materials is temperature dependent, the flow affects the resistance of these legs, sets the bridge into imbalance, and results in a voltage change corresponding to the velocity of the flow. Generally, the resistors most affected by the air flow will be the resistors that are oriented transverse to the direction of the air flow, i.e., the resistors whose entire length is exposed to the flow. However, the resistors oriented in parallel to the flow will also be somewhat affected, depending upon the aspect ratio of the resistor legs. The aspect ratio is the ratio of the length to the width of each resistor leg. The sensitivity of such a device increases as the aspect ratio increases. Thus, for a Wheatstone bridge with legs of a predetermined length, sensitivity can be increased by decreasing the width of the legs.

Exemplary anemometers 80 are fully disclosed in U.S. Pat. Nos. 4,930,347; 5,231,877 and 5,310,449 to Henderson, which are herein incorporated by reference. The change in the resistance and the corresponding change in the voltage of the Wheatstone bridge 82 is used to calculate the velocity of the vapor flowing thereacross, thus providing the basis for a volume calculation by the control system 50. This velocity calculation can be done by using formulas or look-up tables derived during calibration of the system. Thus, prior to the introduction of the anemometer 80 into the vapor recovery line, it is tested in a factory setting and anemometer readings are taken corresponding to known velocities of vapors. The readings are then placed in a look-up table in a memory (not shown) in the control system 50. Alternatively, a formula may be used, which translates a given anemometer reading to a given velocity, again based on the calibration testing performed in the factory.

The anemometer 80 may be positioned at any spot on the vapor return line 34, so long as it is not integrated with the product delivery line 36. This is due to the fact that the heat from the fuel flow in the adjacent line 36 may skew the measurements of the anemometer 80. Thus, while it is possible to place the anemometer 80 anywhere between the split 51 and the pump 60, it is more advantageous to place the anemometer 80 in a location where the vapor flow will be more accurate, such as proximate the pump 60. The closer the anemometer 80 is to the pump 60, the more accurate the measurement because that will be the point at which pressure in the vapor return line is most constant. Additionally, the closer to the pump 60, the less likely that the anemometer 80 will be exposed to liquid fuel. While not inherently problematic or dangerous, the liquid fuel may skew the readings of the anemometer 80, and thus, it is desirable to avoid such fuel to anemometer 80 contact.

The anemometer 80 may be enclosed in a metal sleeve or covered in a coating suitable to the environment in which the anemometer will be placed. Additionally, a temperature sensor 81 may incorporated into the anemometer 80 or positioned proximate thereto to provide an ambient temperature level within the vapor recovery line 34. This would allow a more accurate determination of the velocity of the vapor flow across the Wheatstone bridge 82.

Alternatively, the monitor 66 could take the form seen in FIG. 4, where two temperature probes 84 and 88 are used, and wherein the second probe 88 forms a simple, but effective anemometer. Thus, while the following discussion is in terms of a temperature probe, the use of a temperature probe is equivalent to an anemometer. The first temperature probe 84 includes a temperature sensing device 86. The second temperature probe 88 includes a heat sensing and/or heat creating element 90, which is controlled by a heating control circuit 92. The element 90 may comprise sensing and heating elements combined into a single resistive element such as a resistive temperature device (RTD) or a series of distinct elements such as two thernistors. The temperature probes 84 and 88 in general may be thermistors, thermocouplings, solid state devices, platinum RTDs, or the like. Probe 88 can be positioned within the vapor recovery line 34 similarly to anemometer 80. Additionally, it should be noted that the temperature probes 84 and 88 could, in some embodiments, be part of an integrated chip, especially when the temperature probes 84 and 88 are solid state devices.

The first temperature probe 84 is adapted to measure the temperature of the vapor or air present in the vapor recovery line 34 to provide a frame of reference for the activities of the second temperature probe 88. This is particularly useful where temperatures fluctuate dramatically during the day or even over the course of the year. Because this probe 84 only measures the ambient temperature within the recovery line 34, it is an optional feature, and one probe 88 would suffice to function as an anemometer.

The second temperature probe 88 may function in several ways, both of which are concerned with the emissivity, or the amount of heat radiation from the probe as caused by vapor flow thereacross. Two ways of functioning are of particular interest. First, the heating control circuit 92 can supply a fixed amount of energy to the heat creating portion of element 90, and the sensing portion of element 90 will measure how much the element 90 is cooled by the flow of vapor thereacross. While designed to be precalibrated, ambient temperatures may skew the results elicited from the second temperature probe 88. That is, colder days will usually result in colder vapor, which would cool the probe 88 faster than the actual vapor flow would reflect. The end result could be an erroneous reading that the vapor flow was higher than the actual flow. By detecting the ambient temperature in the vapor recovery line 34 with probe 84, a more proper measurement of the vapor flow may be accomplished.

The second way that the second temperature probe 88 may function is to calculate how much energy it takes to elevate the second temperature probe 88 to a preselected temperature, or how much energy it takes to elevate the second temperature probe 88 by a desired amount (e.g. 5 degrees). Again, the first temperature probe 84 may be used to provide a reference point so that the ambient temperature does not skew the results.

In either case, the emissivity of the monitor 66 is measured as the vapor passing across the anemometer cools the monitor 66, providing an accurate reflection of the vapor velocity. This knowledge coupled with the knowledge of the cross-sectional area of the vapor recovery line 34 allows an accurate calculation of the vapor flow rate. This can be compared to the fuel flow rate, with the goal of making the vapor recovery approximately equal to the fuel dispensing rate, or an A/L ratio equal to 1, achieved by varying the valve 64 opening or the speed of the motor 62.

The present invention provides another advantage over the prior art systems in that it provides information about the vapor being returned, specifically the amount being returned to the UST 40. The actual vapor flow data could be used to show a user (not shown) on the outside, the amount of vapor being captured, or the information could be sent to a further control device in case a problem occurs.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A fuel dispenser having a variable speed vapor recovery system comprising:

a) a fuel delivery system adapted to deliver fuel along a fuel delivery path from a storage tank to a vehicle during a fueling operation;

b) a variable speed vapor recovery system having a vapor recovery path to deliver vapors expelled from the vehicle to the underground storage tank when fuel is delivered during a fueling operation;

c) an anemometer;

d) a control system for controlling said variable speed vapor recovery system, said control system coupled to said anemometer to measure a parameter corresponding to emissivity associated with vapor flowing past the anemometer during a fueling operation and adapted to determine an actual flow rate of vapor in said vapor recovery path and control the vapor recovery system accordingly;

e) wherein said vapor recovery system comprises two constant speed pumps operatively connected to said control system and wherein each pump is associated with a valve controlled by said control system, wherein each of said valves is adapted to control the rate of vapor recovery within different portions of said vapor recovery path.

2. A fuel dispenser having a variable speed vapor recovery system comprising:

a) a fuel delivery system adapted to deliver fuel along a fuel delivery path from a storage tank to a vehicle during a fueling operation;

b) a variable speed vapor recovery system having a vapor recovery path to deliver vapors expelled from the vehicle to the underground storage tank when fuel is delivered during a fueling operation;

c) an anemometer;

d) a control system for controlling said variable speed vapor recovery system, said control system coupled to said anemometer to measure a parameter corresponding to emissivity associated with vapor flowing past the anemometer during a fueling operation and adapted to determine an actual flow rate of vapor in said vapor recovery path and control the vapor recovery system accordingly;

e) wherein said vapor recovery system includes one constant speed pump operatively connected to said control system; said pump associated with two valves controlled by said control system, wherein each of said valves is adapted to control the rate of vapor recovery within different portions of said vapor recovery path.

3. The dispenser of claim 2 wherein said vapor recovery path includes a Y-split having two upstream branches and one downstream branch, each of said valves being positioned in different ones of said upstream branches of said Y-split.

4. A vapor recovery system for use in a fuel dispensing environment, said system comprising:

a) a fuel dispenser having a product delivery line and a vapor recovery line;

b) a pump positioned in said recovery line;

c) an anemometer for taking of vapor flow within said vapor recovery line, said anemometer positioned in said vapor recovery line proximate said pump;

d) a control system operatively connected to said pump and said anemometer, said control system for calculating a flow rate through said vapor recovery line based on said anemometer;

e) wherein said rate of vapor recovery is varied by said control system in response to said calculated vapor recovery rate;

f) a motor operatively connected to said control system, said motor driving said pump; and g) wherein said motor is a constant speed motor.

5. A vapor recovery system for use in a fuel dispensing environment, said system comprising:

a) a fuel dispenser having a product delivery line and a vapor recovery line;

b) a pump positioned in said recovery line;

c) an anemometer for taking of vapor flow within said vapor recovery line, said anemometer positioned in said vapor recovery line proximate said pump;

d) a control system operatively connected to said pump and said anemometer, said control system for calculating a flow rate through said vapor recovery line based on said anemometer;

e) wherein said rate of vapor recovery is varied by said control system in response to said calculated vapor recovery rate;

f) a valve, said valve positioned in said vapor recovery line, said valve positioned in said vapor recovery line, said valve controlled by said control system g) a motor operatively connected to said control system, said motor driving said pump.

6. The vapor recovery system of claim 5 further comprising a motor operatively connected to said control system, said motor driving said pump.

7. The vapor recovery system of claim 6 wherein said motor is a constant speed motor and the position of said valve controls the vapor recovery rate.

8. The vapor recovery system of claim 6 wherein said motor is a variable speed motor and the speed of said motor controls the vapor recovery rate.

9. A vapor recovery system for use in a fuel dispensing environment, said system comprising:

a) a fuel dispenser having a product delivery line and a vapor recovery line;

b) a pump positioned in said vapor recovery line, said pump for controlling the rate at which vapor is recovered through said vapor recovery line;

c) a vapor recovery monitor positioned in said recovery line;

d) a temperature probe positioned in said vapor recovery line proximate said vapor recovery monitor;

e) a control system operatively connected to said pump, said vapor recovery monitor and said temperature probe, wherein said control system controls the rate of vapor recovery in said vapor recovery line based on readings taken from said vapor recovery monitor;

f) a valve positioned in said vapor recovery line.

10. The vapor recovery system of claim 9 further comprising a constant speed motor, and wherein the control system varies the vapor recovery rate by varying the position of said valve.

11. A method for controlling the A/L ratio in a fuel dispenser, said method comprising the steps of:

a) delivering fuel to a vehicle;

b) recovering vapor through a Y intersection;

c) measuring the rate of flow through the vapor recovery line with a vapor recovery monitor positioned proximate a pump.

12. A method for controlling the A/L ratio in a fuel dispenser, said method comprising the steps of:

a) delivering fuel to a vehicle;

b) recovering vapor through a vapor recovery line;

c) measuring the rate of flow through the vapor recovery line with a vapor recovery monitor positioned proximate a pump;

d) controlling the rate of vapor recovery by adjusting the position of a valve.

13. A vapor recovery system for use in a fuel dispensing environment, said system comprising:

a) a fuel dispenser having two sides each served by an individual product delivery line;

b) a vapor recovery line serving both sides of said fuel dispenser, said vapor recovery line having a Y-branch;

c) a control system;

d) a pair of flow meters, each operatively coupled to different ones of said product delivery lines and to said control system for calculating a rate of fuel being dispensed through the respective product delivery line;

e) a pump positioned in said vapor recovery line downstream of said Y-branch and operatively connected to said control system, said pump for controlling the rate at which vapor is recovered through said vapor recovery line; and f) a vapor recovery monitor positioned in said vapor recovery line and operatively coupled to said control system for calculating a rate of vapor recovery;

g) wherein said rate of vapor recovery is varied to approximate the rate of fuel being dispensed.

14. A fuel dispenser having a variable speed vapor recovery system comprising:

a) fuel delivery system adapted to deliver fuel along a fuel delivery path from a storage tank to a vehicle during fueling operation;

b) a variable speed vapor recovery system having a vapor recovery path to deliver vapors expelled form the vehicle to the underground storage tank when fuel is delivered during a fueling operation;

c) a first temperature probe positioned in said vapor recovery line;

d) a control system for controlling said variable speed vapor recovery system, said cotrol system coupled to said first temperature probe during a fueling operation and adapted to determine an actual flow rate of vapor in said recovery path; and e) a second temperature probe positioned in said vapor recovery line proximate said first temperature probe and operatively coupled to said control system, wherein the determination of the actual flow rate is impacted by a reading from the second temperature probe.

15. A fuel dispenser having a variable speed vapor recovery system comprising:

a) fuel delivery system adapted to deliver fuel along a fuel delivery path from a storage tank to a vehicle during fueling operation;

b) a variable speed vapor recovery system having a vapor recovery path to deliver vapors expelled form the vehicle to the underground storage tank when fuel is delivered during a fueling operation;

c) a first temperature probe positioned in said vapor recovery line;

d) a control system for controlling said variable speed vapor recovery system, said control system coupled to said first temperature probe during a fueling operation and adapted to determine an actual flow rate of vapor in said recovery path;

e) a second temperature probe positioned in said vapor recovery line proximate said first temperature probe and operatively coupled to said control system, wherein the determination of the actual flow rate is impacted by a reading from the second temperature probe; and f) wherein said second temperature probe is positioned on an integrated circuit with said first temperature probe.

16. A fuel dispenser having a variable speed vapor recovery system comprising:

a) fuel delivery system adapted to deliver fuel along a fuel delivery path from a storage tank to a vehicle during fueling operation;

b) a variable speed vapor recovery system having a vapor recovery path to deliver vapors expelled form the vehicle to the underground storage tank when fuel is delivered during a fueling operation;

c) a first temperature probe positioned in said vapor recovery line;

d) a control system for controlling said variable speed vapor recovery system, said control system coupled to said first temperature probe during a fueling operation and adapted to determine an actual flow rate of vapor in said recovery path;

e) a second temperature probe positioned in said vapor recovery line proximate said first temperature probe and operatively coupled to said control system, wherein the determination of the actual flow rate is impacted by a reading from the second temperature probe; and f) wherein said second temperature probe is spaced from said first temperature probe.

17. A vapor recovery system for use in a fuel dispensing environment, said system comprising:

a) a fuel dispenser having a product delivery line and a vapor recovery line;

b) a constant speed pump positioned in said vapor recovery line;

c) a vapor recovery monitor for taking readings of vapor flow within said vapor recovery line, said vapor recovery monitor positioned in said vapor recovery line;

d) a control system operatively connected to said pump and said vapor recovery monitor, said control system for calculating a vapor recovery rate through said vapor recovery line based on the readings of said vapor recovery monitor;

e) means for detecting an onboard recovery vapor recovery system, said detecting means operatively connected to said control system;

f) wherein said vapor recovery rate is varied by said control system by adjusting a valve in said vapor recovery line, in response to said calculated vapor recovery rate; and g) wherein said control system further varies said vapor recovery rate based on whether said detecting means detects an onboard recovery vapor recovery system.

18. A method of recovering vapor in a fuel dispensing environment, said method comprising the steps of:

a) delivering fuel to a vehicle;

b) recovering vapor through a vapor recovery line;

c) detecting whether the vehicle includes an onboard recovery vapor recovery system;

d) varying the rate of vapor recovery based on whether the vehicle includes an onboard recovery vapor recovery system;

e) measuring the rate of vapor through said vapor recovery line with a vapor recovery monitor; and f) controlling the rate of vapor recovery by adjusting a valve in said vapor recovery line.

* * * * *

UNITED STATES PATENT AND TRADEMARK OFFICE

CERTIFICATE OF CORRECTION

PATENT NO. : 6,170,539 B1
DATED : January 9, 2001
INVENTOR(S) : Kenneth Pope et al.

It is certified that error appears in the above-identified patent and that said Letters Patent is hereby corrected as shown below:

Title page,
Item [73], Assignee, The assignee name should read -- Marconi Commerce Systems Inc. --.

Signed and Sealed this

Twenty-first Day of January, 2003

JAMES E. ROGAN
*Director of the United States Patent and Trademark Office*